United States Patent [19]

Dessauer

[11] 4,124,439

[45] Nov. 7, 1978

[54] HIGH BULK PAPER OF GREAT STIFFNESS

[75] Inventor: Guido Dessauer, Dusseldorf-Gerresheim, Germany

[73] Assignee: Feldmühle Aktiengesellschaft, Düsseldorf, Germany

[21] Appl. No.: 481,490

[22] Filed: Jun. 21, 1974

[30] Foreign Application Priority Data

Jun. 25, 1973 [DE] Fed. Rep. of Germany ..... 2332294

[51] Int. Cl.[2] ..... D21H 3/38

[52] U.S. Cl. ..... 162/146; 162/166; 162/168 R; 162/175; 162/182; 162/183

[58] Field of Search ..... 162/157 C, 182, 183, 162/166, 175, 146, 168 R

[56] References Cited

U.S. PATENT DOCUMENTS

| | | | |
|---|---|---|---|
| 2,737,179 | 3/1956 | Dahle | 162/157 C |
| 2,998,344 | 8/1961 | Carlson | 162/166 |
| 3,219,519 | 11/1965 | Barber et al. | 162/183 |
| 3,354,034 | 11/1967 | Jarowenko | 162/183 |
| 3,494,825 | 2/1970 | Spielau et al. | 162/183 |
| 3,535,202 | 10/1970 | Huang | 162/166 |
| 3,630,831 | 12/1971 | Jongetjes | 162/183 |
| 3,679,544 | 7/1972 | Ashikaga et al. | 162/182 |
| 3,714,088 | 1/1973 | Manning | 162/157 C |
| 3,878,038 | 4/1975 | Opderbeck et al. | 162/168 R |

FOREIGN PATENT DOCUMENTS

| | | |
|---|---|---|
| 831,505 | 7/1949 | Fed. Rep. of Germany. |
| 1,546,389 | 8/1970 | Fed. Rep. of Germany. |

*Primary Examiner*—Richard V. Fisher
*Assistant Examiner*—Peter Chin
*Attorney, Agent, or Firm*—Hans Berman

[57] ABSTRACT

Paper having adequate mechanical strength and stiffness for use in xerographic equipment at a very low weight is prepared from a stock containing untreated cellulose fibers as well as cellulose fibers stiffened by impregnation with melamine-formaldehyde precondensate or methylolurea, curing of the initially water-soluble resin, and reaction of the cured resin with polyvinyl alcohol or starch ether.

11 Claims, No Drawings

HIGH BULK PAPER OF GREAT STIFFNESS

This invention relates to light-weight paper suitable for use on high-speed xerographic equipment, and particularly to a paper which combines low weight with high stiffness and great bulk.

Paper commercially employed heretofore on high-speed xerographic copying machines has a weight of the order of magnitude of 90 grams per square meter. It was not possible to produce a lighter paper stiff enough to be guided securely through the copying machine, strong enough to withstand repeated folding or creasing, and opaque enough to permit printing on both sides.

It was proposed in the commonly owned application Ser. No. 235,412, filed on Mar. 16, 1972, now U.S. Pat. No. 3,878,038 to impregnate surface layers of a light-weight paper of low density with polymers to impart to the paper the desired combination of properties, particularly the stiffness necessary for proper functioning of the copying machine.

It has now been found that a paper meeting these requirements can be prepared more conveniently from a stock which combines cellulose fibers impregnated with a polymer having available hydroxyl or amino groups, of which a sufficient number is cross linked to reduce the resiliency of the cellulose fibers, with other fibers, such as cellulose fibers, not so impregnated. The impregnated and non-impregnated fibers are uniformly distributed throughout the paper.

The ratio between impregnated cellulose fibers and other fibers may be chosen freely between 10%:90% and 75%:25% without unduly impairing the mechanical strength of the paper and other desirable properties, and it is generally preferred that the impregnated fibers amount to 25% to 65%, all percentage values herein being by weight unless stated otherwise. The optimal proportion of impregnated fibers under specific conditions depends on a multiplicity of factors, such as the origin of the cellulose fibers, that is, whether they are derived from deciduous hardwood trees or from coniferous trees, on the degree of freeness to which the fibers are ground prior to impregnation, on the kind and amount of the cross-linking agents, and on the desired effect.

The impregnated fibers are stiffened by the cross-linked resin system so that a paper prepared conventionally from a stock including the impregnated fibers is much more bulky than would be the case in the absence of impregnation. Much more paper suitable for use on a xerographic copying machine can be produced from a given amount of cellulose than was possible heretofore.

The impregnated cellulose fibers according to the invention lose much of their native resiliency, but, because of the presence of many available hydroxyl and/or amino groups in the impregnating polymer, even after cross-linking, the impregnated fibers are capable of forming hydrogen bonds with each other and with untreated fibers with which they are interengaged in the paper so that the mechanical strength of the paper on a weight basis is not impaired by the increased bulk or volume.

The polymers having available hydroxyl or amino groups should preferably have a molecular weight in the range between 10,000 and approximately 100,000, the specific optimum molecular weight being chosen in accordance with operating conditions as outlined above. The preferred polymer having available hydroxyl groups is polyvinyl alcohol, preferably as fully hydrolyzed, and thus free from acetate moieties, as is economically feasible. Polyvinyl alcohol (PVA) having a molecular weight between 22,000 and 110,000 has been used successfully.

Another polymer containing available hydroxyl groups and suitable for the purpose of this invention is modified starch ether having a molecular weight of 10,000 to 100,000. Gelatine having a molecular weight between 40,000 and 100,000 is a suitable polymer having amino groups capable of being cross-linked by the cross-linking agents of this invention.

The several afore-mentioned polymers having hydroxyl or amino groups may be employed jointly, and may be further combined with proteins, such as casein and soy bean protein in amounts of 10% to 60% based on the weight of the PVA, starch ether, or gelatine.

The preferred cross-linking agents are sources of formyl groups, such as the aldehydes known to cross-link hydroxyl and/or amino groups. The aldehydes may be mixed with the polymers, or the formyl groups may be generated under the processing conditions in the presence of the polymers. The cross-linking agents of the invention thus include, but are not limited to, formaldehyde, acetaldehyde, glyoxal, hexamethylene tetramine, melamine-formaldehyde precondensates, urea-formaldehyde precondensates such as dimethylolurea, and like resins which are water-soluble. Epoxides also may react with the hydroxyl or amino groups of the impregnating polymer, and thus may also be employed as cross-linking agents.

Bonding of the impregnating materials to the fibers may be improved when the cross-linking agents are mixed with 30% to 150% cyanamide.

The cross-linking agents may be cured to the fibers, and thereby made insoluble in water at elevated temperatures in the absence of catalysts, but the curing process is hastened by catalysts, such as sodium chloride, ammonium chloride, hydrochloric acid, or paratoluenesulfonic acid, as is known in itself. Strongest curing effects are achieved at temperatures about 100° C, for example 140° C, which call for use of a sealed pressure vessel.

To improve the aging properties of the paper prepared from a mixed stock according to the invention, it may be advantageous to make the stock alkaline before feeding it to the paper making machine so as to permit sizing with ketenedimers, without the use of rosin sizes which do not always successfully withstand the temperatures to which paper may be exposed in xerographic copying machines.

The cellulose fibers employed may be short or long. The bulk is increased by the use of longer fibers, but surface smoothness improves with shorter fibers. The papers of the invention may be modified in a known manner by adding minor amounts of fillers for improved opacity and other addition agents.

In making paper according to this invention, the treated and untreated fibers are preferably suspended in separate batches of aqueous liquid in amounts between 1% and 5%. In preparing a suspension of the treated fibers, the cross-linking agent is dissolved in the aqueous liquid, and the dry cellulose fibers are immersed in the resulting solution so that the cross-linking agent is drawn into the pores of the fibers by the entering water. The cross-linking agent is exhausted by the fibers from the liquid so that the polymer having available hydroxyl or amino groups is bound to the fibers by the cross-linking agent when added thereafter, and there is no waste of the impregnating materials by reaction of the same in the liquid phase outside the fibers.

The method of the invention permits the preparation of paper eminently suitable for use on xerographic copying machines. Papers of the invention may have an area weight below 90 g/sq. meter and as low as 25 g/sq. meter combined with a density of 0.35 to 0.6 g per cubic centimeter. The best papers produced so far by the method of this invention have a weight of about 50 g per square meter, a density of about 0.5 g/cm$^3$, and a thickness between 90 and 100 microns. They are stiff enough to run smoothly through complex copying machines and like equipment, and have favorable air permeability so that they may be fed by means of suction feeders. They are thermally stable under conditions in which papers containing thermoplastic foam particles cannot be used successfully. Their fibers may consist entirely of cellulose so that they do not tend to turn yellow under the influence of heat or sunlight.

The following Examples are further illustrative of the invention.

EXAMPLE 1

10 kg Pulverulent melamine formaldehyde precondensate ("Madurit OP" of the German chemical manufacturer Casella) was placed in a pulper and uniformly distributed in 1700 liters water by stirring. Thereafter, 50 kg bleached, dry, sulfate cellulose fibers derived from conifer wood were suspended in the liquid. Hydrochloric acid was added to adjust the pH to 4.0 to 4.2, and more hydrochloric acid was added as needed to maintain the pH at the desired value. When the suspension showed no further tendency to rise in pH, the contents of the pulper were heated to 100° C with live steam, and a temperature of about 100° C was maintained for 1 hour while the contents of the pulper were stirred occasionally. Aldehyde vapors developed during the thermal curing of the melamine resin and were vented.

A 10% stock solution was prepared in a separate vessel equipped with a stirrer from water and polyvinyl alcohol (degree of saponification 95–98%; molecular weight 75,000) by holding the components at 94° C for 20 minutes, and cooling the hot solution to ambient temperature in another, water-cooled vessel.

The suspension of resin-treated cellulose fibers was drawn from the pulper, permitted to cool to a temperature not much above the prevailing room temperature and mixed with 15 liters of the PVA solution so that the mixture contained 3% PVA based on the weight of the treated cellulose.

A fiber suspension was prepared in another pulper from 50 kg bleached, birch sulfate cellulose, 50 kg of a bleached sulfate cellulose prepared from a mixture of hardwoods, and enough water to make the cellulose concentration in the suspension approximately 3%.

The suspensions of resin-treated and untreated cellulose fibers were combined in a vat, further mixed with 5% of a white mineral filler (based on the cellulose weight), and a small amount of an optical bleach, and diluted with more water to a solids content of 0.6%.

Paper was then made from the resulting stock on a Fourdrinier type paper machine in a conventional manner. The paper so produced had a weight of approximately 50 g per sq. meter, a thickness of 97 microns, and a bulk density of 0.57 g per cm$^3$.

Its strength of stiffness were sufficient for use in conventional, high-speed, xerographic copying equipment employing a suction feed system.

EXAMPLE 2

5 kg Pulverulent dimethylolurea was distributed in 1700 liters water by stirring in a pulper. 50 kg Dry, bleached, sulfate cellulose fibers from coniferous wood were uniformly suspended in the aqueous liquid, and a pH of 4.0 to 4.2 was set and maintained by means of hydrochloric acid until the pH value became stable. The mixture then was heated by means of live steam to 100° C and held at that temperature for 1 hour with occasional stirring. Aldehyde vapors were vented from the working area. 7.5 Liters of the PVA stock solution prepared in Example 1 were added after cooling of the resin-treated fibers suspension to make the PVA concentration of the resulting mixture 1.5% based on the dry weight of the cellulose fibers.

A 3% cellulose fiber suspension was prepared in a second pulper in the manner and from the materials described in Example 1, the suspensions of treated and untreated cellulose fibers were mixed, filler and optical bleach were added as in Example 1, the suspension was diluted to a solids content of 0.6%, and the resulting stock was fed to the paper machine as described above.

The paper so produced had an area weight of 50 g per sq. meter, a thickness of 87 microns, and a bulk density of 0.575 g/cm$^3$.

Its mechanical and other properties were amply adequate for use in the xerographic copying machine mentioned in Example 1.

EXAMPLE 3

2000 Liters water, 20 kg pulverulent melamine formaldehyde precondensate ("Madurit OP"), and 50 kg dry, sulfate cellulose fibers from coniferous woods were combined as in Example 1 to form a suspension whose pH was adjusted to a value of 4.0 to 4.2 which was maintained by additions of acid until it stabilized. The resin then was cured by heating the suspension with live steam to 100° C and maintaining that temperature for 1 hour. After some cooling of the fiber suspension, 50 liters PVA stock solution (see Example 1) was added to make the PVA concentration 10% based on the fibers present.

A 3% suspension of untreated cellulose fibers was prepared in a separate pulper as described in Example 1, the two fiber suspensions were mixed, filler and optical bleach were added as in Example 1, the mixture was diluted to a solids content of 0.6%, and paper was made in the usual manner.

It had a weight of 50 g per sq. meter, a thickness of 110 microns, and a density of 0.454 g/cm$^3$. Its mechanical properties were closely similar to the aforedescribed papers.

EXAMPLE 4

50 kg Short fibers of birchwood sulfate cellulose and 50 kg short sulfate cellulose fibers prepared from mixed hardwood were converted to an aqueous 3% suspension in a pulper, and 10% dimethylolurea, based on the fibers present, was added. The suspension was adjusted to a stable pH value of 4.0–4.2 with hydrochloric acid, as described above, heated to a boil for 30 minutes, cooled, and drained into a vat in which it was mixed with 30 liters of an aqueous 10% solution of starch ether previously prepared from the ingredients by heating to 95° C for 10 minutes and cooling.

50 kg Long fibers of sulfate cellulose prepared from coniferous wood were ground to a freeness of 32 (Schopper/Riegler), and the suspensions of resin-treated and untreated fibers were combined, adjusted to pH 4.5 with alum, and fed to the paper machine in the usual manner.

The paper so produced had a weight of 50 g per sq. meter, a thickness of 98 microns, and a density of 0.51 g/cm$^3$.

While the invention has been described with particular reference to papers suitable for use in copying equipment in which stiffness, light weight, great bulk and adequate air permeability are important, other uses for a paper having such properties will readily suggest themselves to those skilled in the art. The paper of this invention has been found excellent for use in dust filters, and such use is specifically contemplate.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A light weight paper of relatively high stiffness, said paper essentially consisting of interengaged fibers, 10% to 75% of the weight of said fibers consisting of cellulose fibers uniformly distributed throughout said paper and impregnated with a polymer selected from the group consisting of polyvinyl alcohol and a starch ether having available hydroxyl groups, a sufficient number of said hydroxyl groups being cross-linked by a cross-linking agent to reduce the resiliency of said cellulose fibers as compared to otherwise identical cellulose fibers not so impregnated, the remainder of 90% to 25% of said interengaged fibers being free of said polymer and said cross-linking agent, said paper having a bulk density of 0.35 to 0.6 gram per cubic centimeter.

2. A paper as set forth in claim 1, wherein a sufficient number of said available hydroxyl groups is free from said cross linking agent to permit hydrogen bonding of said polymer to other impregnated fibers and to said fibers free of said polymer.

3. A paper as set forth in claim 1, wherein said polymer has a molecular weight between 10,000 and approximately 100,000, and said remainder essentially consists of cellulose.

4. A paper as set forth in claim 3 having an area weight lower than 90 grams per square meter, but not less than 25 grams per square meter.

5. A paper as set forth in claim 4 and sufficiently permeable to air to be capable of being fed in xerographic equipment by means of suction feeders.

6. A paper as set forth in claim 3, wherein said cross-linking agent is a source of formyl groups.

7. A paper as set forth in claim 6, wherein said source is a water-soluble melamine-formaldehyde precondensate or a water soluble urea-formaldehyde precondensate.

8. A paper as set forth in claim 7, wherein said polymer is polyvinyl alcohol.

9. A method of preparing a light-weight paper of relatively high stiffness essentially consisting of interengaged fibers, 10% to 75% of the weight of said fibers consisting of cellulose fibers uniformly distributed throughout said paper and impregnated with a polymer selected from the group consisting of polyvinyl alcohol and starch ether having available hydroxyl groups, a sufficient number of said hydroxyl groups being cross-linked by a cross-linking agent to reduce the resiliency of said cellulose fibers as compared to otherwise identical cellulose fibers not so impregnated, the remainder of 90% to 25% of said interengaged fibers being free of said polymer and said cross-linking agent, which method comprises:

(a) impregnating cellulose fibers with an aqueous solution of a water-soluble resin selected from the group consisting of melamine-formaldehyde precondensate and methylolurea;

(b) curing said resin on said fibers until the resin is no longer water-soluble;

(c) reacting the cured resin on said fiber with said polymer, the polymer having a molecular weight between 10,000 and approximately 100,000, by contacting the impregnated fibers carrying the cured resin with said polymer in an aqueous medium until said polymer is cross-linked by said cured resin;

(d) dispersing the fibers carrying the cured, reacted resin and fibers free from said resin in an aqueous medium to prepare a paper stock; and (e) making said paper from said stock, the bulk density of said paper being 0.35 to 0.6 g/cm$^3$.

10. A method as set forth in claim 9, wherein said polymer is polyvinyl alcohol, and said fibers free from said resin essentially consist of cellulose.

11. A method as set forth in claim 9, wherein said fibers carrying said resin and said fibers free from said resin are dispersed in said aqueous medium in a combined amount of 1% to 5% of the weight of the resulting paper stock.

* * * * *